US006269892B1

(12) United States Patent
Boulton et al.

(10) Patent No.: US 6,269,892 B1
(45) Date of Patent: Aug. 7, 2001

(54) STEERABLE DRILLING SYSTEM AND METHOD

(75) Inventors: Roger Boulton, Aberdeenshire (GB); Chen-Kang D. Chen, Houston, TX (US); Thomas C. Gaynor, Aberdeen (GB); M. Vikram Rao, Houston, TX (US)

(73) Assignee: Dresser Industries, Inc., Dallas, TX (US)

( * ) Notice: Subject to any disclaimer, the term of this patent is extended or adjusted under 35 U.S.C. 154(b) by 0 days.

(21) Appl. No.: 09/217,764

(22) Filed: Dec. 21, 1998

(51) Int. Cl.[7] ..... E21B 7/04
(52) U.S. Cl. ..... 175/61
(58) Field of Search ..... 175/61, 62, 73, 175/75, 45

(56) References Cited

U.S. PATENT DOCUMENTS

| | | | | |
|---|---|---|---|---|
| Re. 33,751 | | 11/1991 | Geczy et al. | 175/61 |
| 4,828,053 | * | 5/1989 | Maurer et al. | 175/75 |
| 5,441,119 | * | 8/1995 | Head | 175/74 |
| 5,513,714 | | 5/1996 | Downie et al. | 175/76 |
| 5,520,256 | * | 5/1996 | Eddison | 175/61 |
| 5,853,053 | * | 12/1998 | Gilchrist et al. | 175/101 |
| 5,857,531 | * | 1/1999 | Estep et al. | 175/75 |

FOREIGN PATENT DOCUMENTS

WO95/25872 9/1995 (WO) .

OTHER PUBLICATIONS

Article: "Steerable Turbodrilling Setting New ROP Records," Offshore Europe, Aug. 1997.
A.D. Black: "PDC Bit Performance for Rotary, Mud Motor, and Turbine Drilling Applications," SPE 13258 (Society of Petroleum Engineers), pp. 2–11.
F. V. DeLucia et al., "PDM vs. Turbodrill: A Drilling Comparison," SPE 13026 (Society of Petroleum Engineers), pp.2–7.
Frank V. DeLucia: "System Analysis Improves Downhole Motor Performance," Oil and Gas Journal, May 17, 1998,m pp.50–53.
B.B. Bayoud: "Downhole Motors Increase ROP and Reduce Cost Per Foot in the Austin Chalk Trend," 1998 SPE/IASDC 18631Drilling Conference, New Orleans, Louisiana, Feb. 28–Mar. 3.
William King: "1997 Update Bit Selection for Coiled Tubing Drilling," PNEC Conferences –1997.
J. Norris et al.: "Developement and Successful Application of Unique Steerable PDC Bits," IADC/SPE 39308 Drilling Conference, Dallas, Texas, Mar. 3–6 1998, pp. 155–166.
J.P. Belaskie et al.: "Distinct Applications of MWD, Weight on Bit, and Torque," SPE Drilling & Completion, Jun. 1993, pp. 111–112.

* cited by examiner

*Primary Examiner*—Thomas B. Will
*Assistant Examiner*—Kristine Markovich
(74) *Attorney, Agent, or Firm*—Browning Bushman

(57) ABSTRACT

A bottom hole assembly 10 for drilling a deviated borehole includes a positive displacement motor 12 having a substantially uniform diameter motor housing outer surface without stabilizers extending radially therefrom. The motor housing 14 has a fixed bend therein between an upper power section 16 and a lower bearing section 18. The long gauge bit 20 powered by the motor 10 has a bit face 22 with cutters 28 thereon and a gauge section 24 having a uniform diameter cylindrical surface 26. The gauge section 24 has an axial length at least 75% of the bit diameter. The axial spacing between the bit face and the bend of the motor housing is less than ten times the bit diameter. According to the method of the present invention, fluid is pumped through the downhole motor to rotate the bit at a speed of less than 350 rpm. A substantial portion of the curved borehole section may be drilled while sliding rather than rotating the motor housing.

34 Claims, 2 Drawing Sheets

STEERABLE DRILLING SYSTEM AND METHOD

FIELD OF THE INVENTION

The present invention relates to a steerable bottom hole assembly including a rotary bit powered by a positive displacement motor. The bottom hole assembly of the present invention may be utilized to efficiently drill a deviated borehole at a high rate of penetration.

BACKGROUND OF THE INVENTION

Steerable drilling systems are increasingly used to controllably drill a deviated borehole from a straight section of a wellbore. In a simplified application, the wellbore is a straight vertical hole, and the drilling operator desires to drill a deviated borehole off the straight wellbore in order to thereafter drill substantially horizontally in an oil bearing formation. Steerable drilling systems conventionally utilize a downhole motor (mud motor) powered by drilling fluid (mud) pumped from the surface to rotate a bit. The motor and bit are supported from a drill string that extends to the well surface. The motor rotates the bit with a drive linkage extending through a bent sub or bent housing positioned between the power section of the motor and the drill bit. Those skilled in the art recognize that the bent sub may actually comprise more than one bend to obtain a net effect which is hereafter referred to for simplicity as a "bend" and associated "bend angle."

To steer the bit, the drilling operator conventionally holds the drill string from rotation and powers the motor to rotate the bit while the motor housing is advanced (slides) along the borehole during penetration. During this sliding operation, the bend directs the bit away from the axis of the borehole to provide a slightly curved borehole section, with the curve achieving the desired deviation or build angle. When a straight or tangent section of the deviated borehole is desired, the drill string and thus the motor housing are rotated, which generally causes a slightly larger bore to be drilled along a straight path tangent to the curved section. U.S. Pat. No. 4,667,751, now RE 33,751, is exemplary of the prior art relating to deviated borehole drilling. Most operators recognize that the rate of penetration (ROP) of the bit drilling through the formation is significantly less when the motor housing is not rotated, and accordingly sliding of the motor with no motor rotation is conventionally limited to operations required to obtain the desired deviation or build, thereby obtaining an overall acceptable build rate when drilling the deviated borehole. Accordingly, the deviated borehole typically consists of two or more relatively short length curved borehole sections, and one or more relatively long tangent sections each extending between two curved sections.

Downhole mud motors are conventionally stabilized at two or more locations along the motor housing, as disclosed in U.S. Pat. No. 5,513,714, and WO 95/25872. The bottom hole assembly (BHA) used in steerable systems commonly employs two or three stabilizers on the motor to give directional control and to improve hole quality. Also, selective positioning of stabilizers on the motor produces known contact points with the wellbore to assist in building the curve at a predetermined build rate.

While stabilizers are thus accepted components of steerable BHAs, the use of such stabilizers causes problems when in the steering mode, i.e., when only the bit is rotated and the motor slides in the hole while the drill string and motor housing are not rotated to drill a curved borehole section.

Motor stabilizers provide discrete contact points with the wellbore, thereby making sliding of the BHA difficult while simultaneously maintaining the desired WOB. Accordingly, drilling operators have attempted to avoid the problems caused by the stabilizers by running the BHA "slick," i.e., with no stabilizers on the motor housing. Directional control may be sacrificed, however, because the unstabilized motor can more easily shift radially when drilling, thereby altering the drilling trajectory.

Bits used in steerable assemblies commonly employ fixed PDC cutters on the bit face. The bit gauge length is the axial length of the sleeve extending from the bit face, and typically is formed from a high wear resistant material. Drilling operations conventionally use a bit with a short gauge length. A short bit gauge length is desired since, when in the steering mode, the side cutting ability of the bit required to initiate a deviation is adversely affected by the bit gauge length. Along gauge on a bit is commonly used in straight hole drilling to avoid or minimize any build, and accordingly is considered contrary to the objective of a steerable system. A long gauge bit is considered by some to be functionally similar to a conventional bit and a "piggyback" or "tandem" stabilizer immediately above the bit. This piggyback arrangement has been attempted in a steerable BHA, and has been widely discarded since the BHA has little or no ability to deviate the borehole trajectory. The accepted view has thus been that the use of a long gauge bit, or a piggyback stabilizer immediately above a conventional short gauge bit, in a steerable BHA results in the loss of the drilling operator's ability to quickly change direction, i.e., they do not allow the BHA to steer or steering is very limited and unpredictable. The use of PDC bits with a double or "tandem" gauge section for steerable motor applications is nevertheless disclosed in SPE 39308 entitled "Development and Successful Application of Unique Steerable PDC Bits."

Most steerable BHAs are driven by a positive displacement motor (PDM), and most commonly by a Moineau motor which utilizes a spiraling rotor which is driven by fluid pressure passing between the motor and stator. PDMs are capable of producing high torque, low speed drilling that is generally desirable for steerable applications. Some operators have utilized steerable BHAs driven by a turbine-type motor, which is also referred to as a turbodrill. A turbodrill operates under a concept of fluid slippage past the turbine vanes, and thus operates at a much lower torque and a much higher rotary speed than a PDM. Most formations drilled by PDMs cannot be economically drilled by turbodrills, and the use of turbodrills to drill curved boreholes is very limited. Nevertheless, turbodrills have been used in some steerable applications, as evidenced by the article "Steerable Turbodrilling Setting New ROP Records," OFFSHORE, August 1997, pp. 40 and 42. The action of the PDC bit powered by a PDM is also substantially different than the action of a PDC bit powered by a turbodrill because the turbodrill rotates the bit at a much higher speed and a much lower torque.

Turbodrills require a significant pressure drop across the motor to rotate the bit, which inherently limits the applications in which turbodrills can practically be used. To increase the torque in the turbodrill, the power section of the motor has to be made longer. Power sections of conventional turbodrills are often 30 feet or more in length, and increasing the length of the turbodrill power section is both costly and adversely affects the ability of the turbodrill to be used in steerable applications.

Those skilled in the art have long sought improvements in the performance of a steerable BHA which will result in a higher ROP, particularly if a higher ROP can be obtained with better hole quality and without adversely affecting the ability of the BHA to reliably steer the bit. Such improvements in the BHA and in the method of operating the BHA would result in considerable savings in the time and money utilized to drill a well, particularly if the BHA can be used to penetrate farther into the formation before the BHA is retrieved to the surface for altering the BHA or for replacing the bit. By improving the quality of both the curved borehole sections and the straight borehole sections of a deviated borehole, the time and money required for inserting a casing in the well and then cementing the casing in place are reduced. The long standing goal of an improved steerable BHA and method of drilling a deviated borehole has thus been to save both time and money in the production of hydrocarbons.

SUMMARY OF THE INVENTION

An improved bottom hole assembly (BHA) is provided for controllable drilling a deviated borehole. The bottom hole assembly includes a positive displacement motor (PDM) driven by pumping downhole fluid through the motor. The motor is preferably slick in that it has a substantially uniform diameter motor housing outer surface without stabilizers extending radially therefrom. The motor housing has a bend therein such that a lower bearing central axis is offset at a selected angle from a power section central axis. The bottom hole assembly includes a long gauge bit powered by the motor, with the bit having a bit face having cutters thereon and defining a bit diameter, and a long cylindrical gauge section above the bit face. The gauge section has an axial length of at least 75% of the bit diameter. Most importantly, the axial spacing between the bend and the bit face is controlled to less than ten times the bit diameter.

According to the method of the invention, a bottom hole assembly is preferably provided with a slick motor housing having a uniform diameter outer surface without stabilizers extending radially therefrom. Fluid is pumped through the downhole motor to rotate the bit at a speed of less than 350 rpm. The motor rotates a bit with a gauge section having an axial length of at least 75% of the bit diameter. The axial spacing between the bend and the bit face is controlled to less than ten times the bit diameter. When drilling the deviated borehole, a low WOB may be applied to the bit face compared to prior art drilling techniques.

It is an object of the present invention to provide an improved BHA for drilling a deviated borehole at a high rate of penetration (ROP) compared to prior art BHAs. This high ROP is achieved both when the motor housing is slid to drill the curved borehole sections and when rotating the motor housing to drill the straight or tangent borehole sections.

It is a related object of the invention to form a deviated borehole with a BHA utilizing improved drilling methods so that the borehole quality is enhanced compared to the borehole quality obtained by prior art methods. The improved borehole quality, including the reduction or elimination of borehole spiraling, results in higher quality formation evaluation logs and subsequently allows the casing or liner to subsequently be more easily slid through the deviated borehole.

It is a feature of the invention to provide a method for drilling a deviated borehole wherein the weight-on-bit (WOB) as measured at the surface is substantially reduced compared to prior art systems by eliminating the drag normally attributable to conventional BHAs.

Another feature of the invention is a method of drilling a deviated borehole wherein a larger portion of the deviated borehole may be drilled with the motor sliding and not rotating compared to prior art methods. The length of the curved borehole sections compared to the straight borehole sections may thus be significantly increased.

Still another feature of the invention is that the BHA may include a relatively short drill collar section above the motor. This saves the cost of additional drill collars and facilitates moving the BHA through the deviated borehole and reduces the tendency of getting stuck.

Another feature of the invention is that hole cleaning is improved over conventional drilling methods.

It is also a feature of the invention to improve borehole quality by providing a BHA with a PDM for powering a long gauge bit which reduces bit whirling and hole spiraling. A related feature of the invention achieves a reduction in the bend in the motor housing to reduce both spiraling and whirling. The reduced bend angle in the motor housing reduces stress on the motor and minimizes bit whirling when drilling a straight tangent section of the deviated borehole. The reduced bend motor nevertheless achieves the desired build rate because of the short distance between the bend and the bit face, and due to the increased tendency to drill the deviated borehole with the motor housing sliding rather than rotating within the borehole.

It is an advantage of the present invention that the spacing between the bend in a PDM and the bit face may be reduced by providing a motor with a shaft having a pin connection at its lowermost end for mating engagement with a box connection of a long gauge bit. This connection may be made within the long gauge of the bit to increase rigidity.

Another advantage of the invention is that a relatively low torque PDM may be efficiently used in the BHA when drilling a deviated borehole. Relatively low torque requirements for the motor allow the motor to be reliably used in high temperature applications. The low torque output requirement of the PDM may also allow the power section of the motor to be shortened.

A significant advantage of this invention is that a deviated borehole is drilled with a PDM which drives a bit while subjecting the bit to a relatively consistent and low actual WOB compared to prior art drilling systems. Lower actual WOB allows for the use of a shorter bearing assembly in the downhole motor, which then contributes to a low spacing between the bend and the bit face and thus improved borehole quality.

It is also an advantage of the present invention that the bottom hole assembly is relatively compact. Sensors provided in the drill bit may transmit signals to a measurement-while-drilling (MWD) system, which then transmits borehole information to the surface while drilling the deviated borehole, thus further improving the drilling efficiency.

A significant advantage of this invention is that the BHA results in surprisingly low axial, radial and circumference vibrations to the benefit of all BHA components, thereby increasing the reliability and longevity of the BHA.

Still another advantage of the invention is that the BHA may be used to drill a deviated borehole while suspended in the well from coiled tubing.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
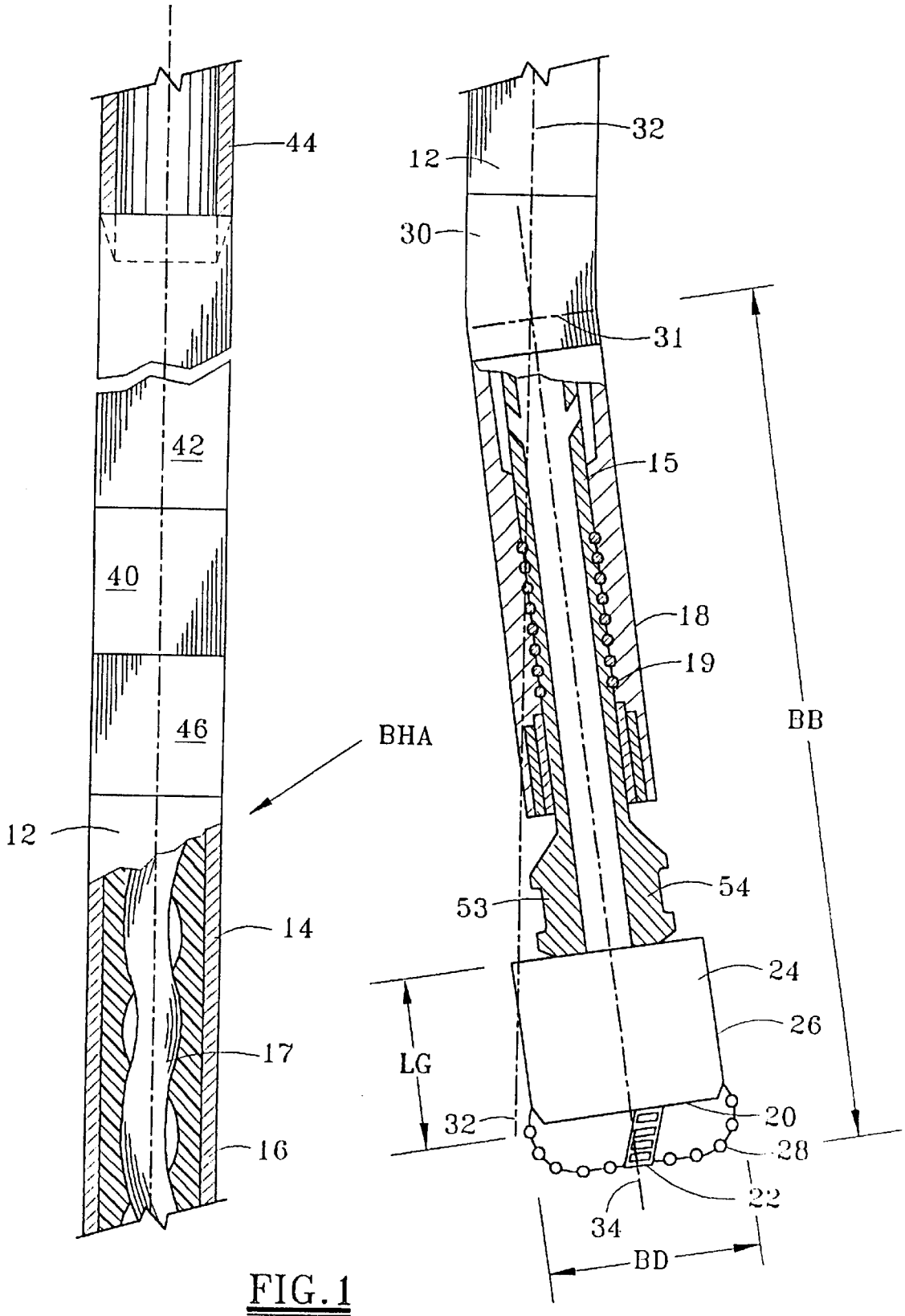
FIG. 1 is a general schematic representation of a bottom hole assembly according to the present invention for drilling a deviated borehole.

FIG. 1 depicts a bottom hole assembly (BHA) for drilling a deviated borehole. The BHA consists of a PDM 12 which is conventionally suspended in the well from the threaded tubular string, such as a drill string 44, although alternatively the PDM of the present invention may be suspended in the well from coiled tubing, as explained subsequently. PDM 12 includes a motor housing 14 having a substantially cylindrical outer surface along at least substantially its entire length. The motor has an upper power section 16 which includes a conventional lobed rotor 17 for rotating the motor output shaft 15 in response to fluid being pumped through the power section 16. Fluid thus flows through the motor stator to rotate the axially curved or lobed rotor 17. A lower bearing housing 18 houses a bearing package assembly 19 which comprising both thrust bearings and radial bearings. Housing 18 is provided below bent housing 30, such that the power section central axis 32 is offset from the lower bearing section central axis 34 by the selected bend angle. This bend angle is exaggerated in FIG. 1 for clarity, and according to the present invention is less than about 1.25°. FIG. 1 also simplistically illustrates the location of an MWD system 40 positioned above the motor 12. The MWD system 40 transmits signals to the surface of the well in real time, as discussed further below. The BHA also includes a drill collar assembly 42 providing the desired weight-on-bit (WOB) to the rotary bit. The majority of the drill string 44 comprises lengths of metallic drill pipe, and various downhole tools, such as cross-over subs, stabilizer, jars, etc., may be included along the length of the drill string.

The term "motor housing" as used herein means the exterior component of the PDM 12 from at least the uppermost end of the power section 16 to the lowermost end of the lower bearing housing 18. As explained subsequently, the motor housing does not include stabilizers thereon, which are components extending radially outward from the otherwise cylindrical outer surface of a motor housing which engage the side walls of the borehole to stabilize the motor. These stabilizers functionally are part of the motor housing, and accordingly the term "motor housing" as used herein would include any radially extending components, such as stabilizers, which extend outward from the otherwise uniform diameter cylindrical outer surface of the motor housing for engagement with the borehole wall to stabilize the motor.

The bent housing 30 thus contains the bend 31 which defines the selected bend angle between the axis 32 and the axis 34. In a preferred embodiment, the bent housing 30 is an adjustable bent housing so that the angle of the bend 31 may be selectively adjusted in the field by the drilling operator. Alternatively, the bent housing 30 could have a bend 31 with a fixed bend angle therein.

The BHA also includes a rotary bit 20 having a bit end face 22. A bit 20 of the present invention includes a long gauge section 24 with a cylindrical outer surface 26 thereon. Fixed PDC cutters 28 are preferably positioned about the bit face 22. The bit face 22 is integral with the long gauge section 24. The axial length (LG) of the gauge section 24 is at least 75% of the bit diameter (BD) as defined by the fullest diameter of the cutting end face 22, and preferably the axial length of gauge section 24 is at least 90% of the bit diameter. In many applications, the bit 20 will have a gauge section 24 wherein the axial length of the gauge section is from one to one and one-half times the bit diameter. The long gauge section 24 of the bit may be 1/32nd inch undersized compared to the bit diameter. The preferred drill bit may be configured to account for the strength, abrasivity, plasticity and drillability of the particular rock being drilled by the deviated hole. Drilling analysis systems as disclosed in U.S. Pat. Nos. 5,704,436, 5,767,399 and 5,794,720 may be utilized so that the bit utilized according to this invention may be ideally suited for the rock type and drilling parameters intended.

The improved ROP in conjunction with the desired hole quality along the deviated borehole achieved by the BHA is obtained by maintaining a short distance (BB) between the bend 31 and the bit face 22. According to the present invention, this axial spacing along the lower bearing section central axis 34 between the bend 31 and the bit face 22 is less than ten times the bit diameter, and preferably is less than about eight times the bit diameter. This short spacing is obviously also exaggerated in FIG. 1, and those skilled in the art appreciate that the bearing pack assembly is axially much longer and more complex than depicted in FIG. 1. This low spacing between the bend and the bit allows for the same build rate with less of a bend angle in the motor housing, thereby improving the hole quality.

Figures 2, 3:
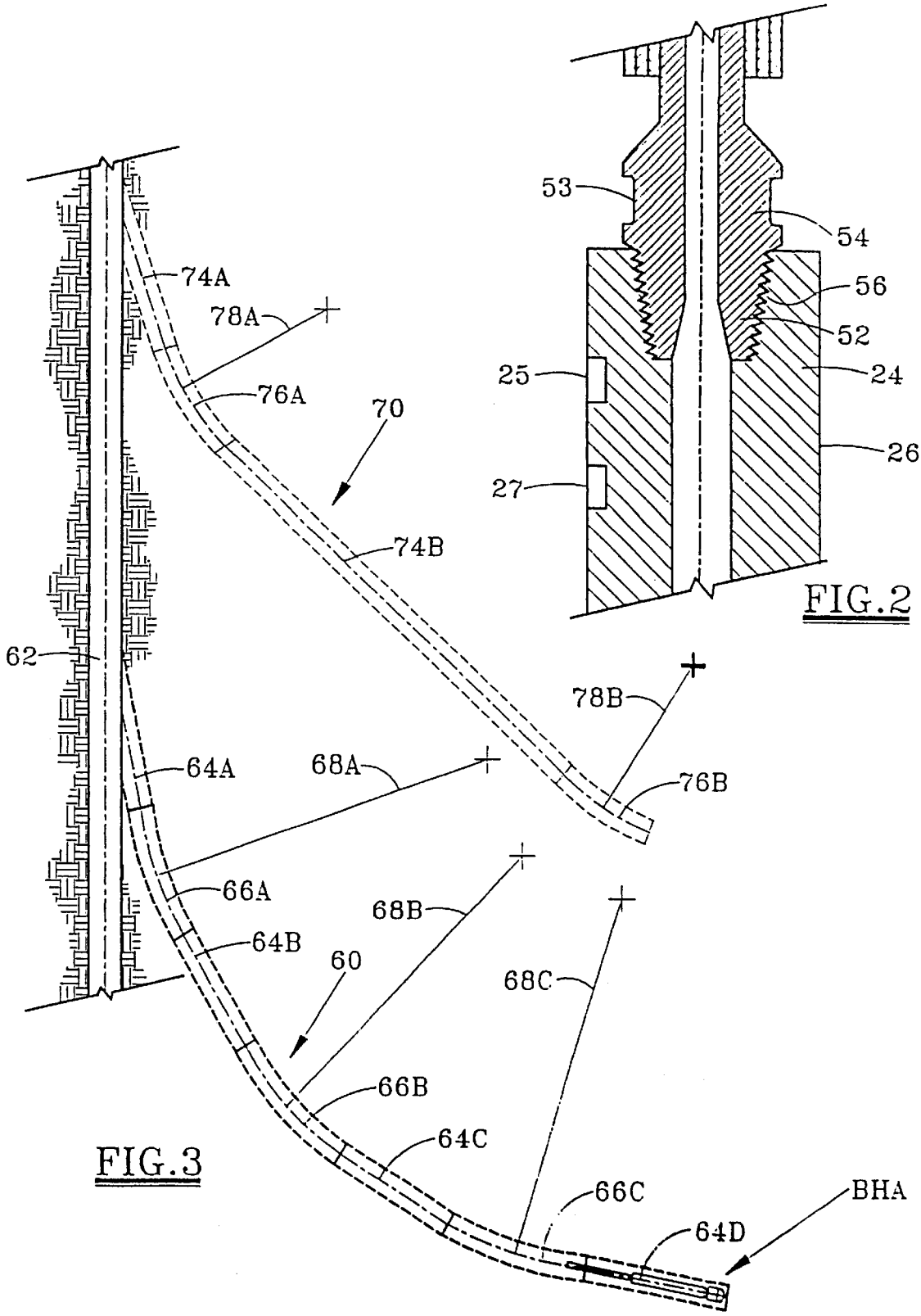
FIG. 2 illustrates a side view of the upper portion of a long gauge drill bit as generally shown in FIG. 1 and the interconnection of the box up drill bit with the lower end of a pin down shaft of a positive displacement motor.
FIG. 3 illustrates the bit trajectory when drilling a deviated borehole according to a preferred method of the invention, and illustrates in dashed lines the more common trajectory of the drill bit when drilling a deviated borehole according to the prior art.

In order to reduce the distance between the bend and the bit face, the PDM motor is preferably provided with a pin connection 52 at the lowermost end of the motor shaft 54, as shown in FIG. 2. The combination of a pin down motor and a box end 56 on the long gauge bit 20 thus allows for a very short bend to bit face distance. The lowermost end of the motor shaft 54 extending from the motor housing includes radially opposing flats 53 for engagement with a conventional tool to temporarily prevent the motor shaft from rotating when threading the bit to the motor shaft. To shorten the length of the bearing pack assembly 19, metallic thrust bearings and metallic radial bearings may be used rather than composite rubber/metal thrust bearings. In PDM motors, the length of the bearing pack assembly is largely a function of the number of radial thrust bearings or thrust bearing packs in the bearing package, which in turn is related to the WOB. By reducing the WOB, the length of the bearing package and thus the bend to bit face distance may be reduced. This relationship is not valid for a turbodrill, wherein the length of the bearing package is primarily a function of the hydraulic thrust, which in turn relates to the pressure differential across the turbodrill. The combination of the metallic bearings and most importantly the short spacing between the bend and the lowermost end of the motor significantly increases the stiffness of this bearing section 18 of the motor. The short bend to bit face distance is important to the improved stability of the BHA when using a long gauge bit. This short distance also allows for the use of a low bend angle in the bent housing 30 which also improves the quality of the deviated borehole.

The PDM is preferably run slick with no stabilizers for engagement with the wall of the borehole extending outward from the otherwise uniform diameter cylindrical outer surface of the motor housing. The PDM may, however, incorporate a slide or wear pad. The motor of the present invention rotates a long gauge bit which, according to conventional teachings, would not be used in a steerable system due to the inability of the system to build at an acceptable and predictable rate. It has been discovered, however, that the combination of a slick PDM, a short bend to bit distance, and a long gauge bit achieve both very acceptable build rates and remarkably predictable build rates for the BHA. By providing the motor slick, the WOB, as measured at the surface, is significantly reduced since substantial forces otherwise required to stabilize the BHA within the deviated borehole while building are eliminated. Very low WOB as measured at the surface compared to the WOB used to drill with prior art BHAs is thus possible according to the method of the invention since the erratic sliding forces attributed to the use of stabilizers on the motor housing are eliminated. Accordingly, a comparatively low and comparatively constant actual WOB is applied to the bit, thereby resulting in much more effective cutting action of the bit and increasing ROP. This reduced WOB allows the operator to drill farther and smoother than using a conventional BHA system. Moreover, the bend angle of the PDM is reduced, thereby reducing drag and thus reducing the actual WOB while drilling in the rotating mode.

BHA modeling has indicated that WOB for a particular application may be reduced from approximately 30,000 lbs to approximately 12,000 lbs merely by reducing the bend to bit face distance from about eight feet to about five feet. In this application, the bit diameter was 8½ inches, and the diameter of the mud motor was 6¾ inches. In an actual field test, however, the BHA according to the present invention with a slick PDM and a long gauge bit, with the reduced five feet spacing between the bend and the bit face, was found to reliably build at a high ROP with a WOB as measured at the surface of about 3,400 lbs. Thus the actual WOB was about one-ninth the WOB anticipated by the model using the prior art BHA. The actual WOB according to the method of this invention is preferably maintained at less than 180 pounds of axial force, and frequently less than 150 pounds of axial force, on the bit face cross-sectional area. This area is determined by the bit diameter since the bit face itself may be curved, as shown in FIG. 1.

A lower actual WOB also allows the use for a lower torque PDM and a longer drilling interval before the motor will stall out while steering. Moreover, the use of a long gauge bit powered by a slick motor surprisingly was determined to build at very acceptable rates and be more stable in predicting build than the use of a conventional short gauge bit powered by a slick motor. Sliding ROP rates were as high as 4 to 5 times the sliding ROP rates conventionally obtained using prior art techniques. In a field test, the ROP rates were 100 feet per hour in rotary (motor housing rotated) and 80 feet per hour while sliding (motor housing oriented to build but not rotated). The time to drill a hole was cut to approximately one quarter and the liner thereafter slid easily in the hole.

The use of the long gauge bit is believed to contribute to improved hole quality. Hole spiraling creates great difficulties when attempting to slide the BHA along the deviated borehole, and also results in poor hole cleaning and subsequent poor logging of the hole. Those skilled in the art have traditionally recognized that spiraling is minimized by stabilizing the motor. The concept of the present invention contradicts conventional wisdom, and high hole quality is obtained by running the motor slick and by using the long gauge bit at the end of the motor with the bend to bit face distance being minimized.

The high quality and smooth borehole are believed to result from the combination of the short bend to bit spacing and the use of a long gauge bit to reduce bit whirling, which contributes to hole spiraling. Hole spiraling tends to cause the motor to "hang-and-release" within the drilled hole. This erratic action, which is also referred to as axial "stick-slip," leads to inconsistent actual WOB, causes high vibration which decreases the life of both the motor and the bit, and detracts from hole quality. A high ROP is thus achieved when drilling a deviated borehole in part because a large reserve of motor torque, which is a function of the WOB, is not required to overcome this axial stick-slip action and prevent the motor from stalling out. By eliminating hole spiraling, the casing subsequently is more easily slid into the hole. The PDM rotates the motor at a speed of less than 350 rpm, and typically less than 200 rpm. With the higher torque output of a PDM compared to that of a turbodrill, one would expect more bit whirling, but that has not proven to be a significant problem. Surprisingly high ROP is achieved with a very low WOB for a BHA with a PDM, with little bit whirling and no appreciable hole spiraling as evidenced by the ease of inserting the casing through the deviated borehole. Any bit whirling which is experienced may be further reduced or eliminated by minimizing the walk tendency of the bit, which also reduces bit whirling and hole spiraling. Techniques to minimize bit walking as disclosed in U.S. Pat. No. 5,099,929 may be utilized. This same patent discloses the use of heavy set, non-aggressive, relatively flat faced drill bits to limit torque cyclicity. Further modifications to the bit to reduce torque cyclicity are disclosed in a paper entitled "1997 Update, Bit Selection For Coiled Tubing Drilling" by William W. King, delivered to the PNEC Conference in October of 1997. The techniques of the present invention may accordingly benefit by drilling a deviated borehole at a high ROP with reduced torque cyclicity. Drill bits with whirl resistant features are also disclosed in a brochure entitled "FM 2000 Series" and "FS 2000 Series."

Field tests have led to the conclusion that the long gauge bit in combination with the short spacing between the bend in the bit face produces unexpected results which are not obtained if the long gauge bit is replaced with a conventional bit and a stabilizer immediately above the bit. The reason for this difference is not fully understood at this time, although the combination of a short gauge bit and stabilizer is undesirably axially longer than the long gauge bit, thereby inherently increasing the spacing between the bit face and the bend. This further suggests the importance of the short bend to bit face spacing.

The significant reduction in WOB as measured at the surface while the motor is sliding to build is believed primarily to be attributable to the significant reduction in the forces used to overcome drag. The significant reduction in actual WOB allows for reduced length bearing pack, which in turn allows for a reduced spacing between the bend and the bit face. These factors thus allow the use of a smaller bend angle to achieve the same build rate, which in turn results in a much higher hole quality, both when sliding to form the curved section of the borehole and when subsequently rotating the motor housing to drill a straight line tangent section.

The concepts of the present invention thus result in unexpectedly higher ROP while the motor is sliding. The lower bend angle in the motor housing also contributes to high drilling rates when the motor housing is rotated to drill a straight tangent section of the deviated borehole. The hole quality is thus significantly improved when drilling both the curved section and the straight tangent section of the deviated borehole by minimizing or avoiding hole spiraling. A motor with a 1° bend according to the present invention may thus achieve a build comparable to the build obtained with a 2° bend using a prior art BHA. The bend in the motor housing according to this invention is preferably less than about 1.25°, and typically is less than 1°. By providing a bend less than 1.25°, the motor can be rotated to drill a straight tangent section of the deviated borehole without inducing high stresses in the motor.

Reduced WOB may be obtained in large part because the motor is slick, thereby reducing drag. Because of the high quality of the hole and the reduced bend angle, drag is further reduced. The consistent actual WOB results in efficient bit cutting since the PDC cutters can efficiently cut with a reliable shearing action and with minimal excessive WOB. The BHA builds a deviated borehole at a surprisingly consistent azimuth.

Since the actual WOB is significantly reduced, the torque requirements of the PDM are reduced. Torque-on-bit (TOB) is a function of the actual WOB and the depth of cut. When the actual WOB is reduced, the TOB may also be reduced, thereby reducing the likelihood of the motor stalling and reducing excessive motor wear. In some applications, this may allow a less aggressive and lower torque lobe configuration for the rotor to be used. This in turn may allow the PDM to be used in high temperature drilling applications since the stator elastomer has better life in a low torque mode. The low torque lobe configuration also allows for the possibility of utilizing more durable metal rotor and stator components, which have longer life than elastomers, particularly under high temperature conditions. The relatively low torque output requirement of the PDM also allows for the use of a short length power section. According to the present invention, the axial spacing along the power section central axis between the uppermost end of the power section of the motor and the bend is less than 40 times the bit diameter, and in many applications is less than 30 times the bit diameter. This short motor power section both reduces the cost of the motor and makes the motor more compatible for traveling through a deviated borehole without causing excessive drag when rotating the motor or when sliding the motor through a curved section of the deviated borehole.

The reduced WOB, both actual and as measured at the surface, required to drill at a high ROP desirably allows for the use of a relatively short drill collar section above the motor. Since the required WOB is reduced, the length of the drill collar section of the BHA may be significantly reduced to less than about 200 feet, and frequently to less than about 160 feet. This short drill collar length saves both the cost of expensive drill collars, and also facilitates the BHA to easily pass through the deviated borehole during drilling while minimizing the stress on the threaded drill collar connections.

When sliding the motor to build, ROP rates are generally considered significantly lower than the rates achieved when rotating the motor housing. Also, prior tests have shown that the combination of (1) a fairly sharp build obtained by sliding the motor with no rotation, (2) followed by a straight hole tangent achieved by rotating the motor housing, and then (3) another fairly sharp build, results in less overall torque and drag than a slow build trajectory along a continuous curve.

The present invention largely contradicts the above assumption by achieving a high ROP using a slick BHA assembly, with a substantial portion of the deviated borehole being obtained by a continuous curve sections obtained when steering rather than by a straight tangent section obtained when rotating the motor housing. According to the present invention, relatively long sections of the deviated borehole, typically at least 40 feet in length and often more than 50 feet in length, may be drilled with the motor being slid and not rotating, with a continuous curve trajectory achieved with a low angle bend in the motor. Thereafter, the motor housing may be rotated to drill the borehole in a straight line tangent to better remove cuttings from the hole. The motor rotation operation may then be terminated and motor sliding again continued.

It is a particular feature of the invention that in excess of 25% of the length of the deviated borehole may be obtained by sliding a non-rotating motor. This percentage is substantially higher than that taught by prior art techniques, and in many cases may be as high as 40% or 50% of the length of the deviated borehole, and may even be as much as 100%, without significant impairment to ROP and hole cleaning. The operator accordingly may plan the deviated borehole with a substantial length being along a continuous smooth curve rather than a sharp curve, a comparatively long straight tangent section, and then another sharp curve.

Referring to FIG. 3, the deviated borehole 60 according to the present invention is drilled from a conventional vertical borehole 62 utilizing the BHA simplistically shown in FIG. 3. The deviated borehole 60 consists of a plurality of tangent borehole sections 64A, 64B, 64C and 64D, with curved borehole sections 66A, 66B and 66C each spaced between two tangent borehole sections. Each curved borehole section 66 thus has a curved borehole axis formed when sliding the motor during a build mode, while each tangent section 64 has a straight line axis formed when rotating the motor housing. When forming curved sections of the deviated borehole, the motor housing may be slid along the borehole wall during the building operations. The overall trajectory of the deviated borehole 60 thus much more closely approximates a continuous curve trajectory than that commonly formed by conventional BHAs.

FIG. 3 also illustrates in dashed lines the trajectory 70 of a conventional deviated borehole, which may include an initial relatively short straight borehole section 74A, a relatively sharp curved borehole section 76A, a long tangent borehole section 74B with a straight axis, and finally a second relatively sharp curved borehole section 76B. Conventional deviated borehole drilling systems demand a short radius, e.g., 78A, 78B, because drilling in the sliding mode is slow and because hole cleaning in this mode is poor. However, a short radius causes undesirable tortuosity with attendant concerns in later operations. Moreover, a short radius for the curved section of a deviated borehole increases concern for adequate cuttings removal, which is typically a problem while the motor housing is not rotated while drilling. A short bend radius for the curved section of a deviated borehole is tolerated, but conventionally is not desired. According to the present invention, however, the curved sections of the deviated borehole may each have a radius, e.g., 68A, 68B and 68C, which is appreciably larger than the radius of the curved sections of a prior art deviated borehole, and the overall drilled length of these curved sections may be much longer than the curved sections in prior art deviated boreholes. As shown in FIG. 3, the operation of sliding the motor housing to form a curved section of the deviated borehole and then rotating the motor housing to form a straight tangent section of the borehole may each be performed multiple times, with a rotating motor operation performed between two motor sliding operations.

The desired drilling trajectory may be achieved according to the present invention with a very low bend angle in the motor housing because of the reduced spacing between the bend and the bit face, and because a long curved path rather than a sharp bend and a straight tangent section may be drilled. In many applications wherein the drilling operators may typically use a BHA with a bend of approximately 1½°, the concepts of the present invention may be applied and the trajectory drilled at a faster ROP along a continuous curve with BHA bend angle at ¾° or less. This reduced bend angle increases the quality of the hole, and significantly reduces the stress on the motor.

The BHA of the present invention may also be used to drill a deviated borehole when the BHA is suspended in the well from coiled tubing rather than conventional threaded drill pipe. The BHA itself may be substantially as described herein, although since the azimuth of the bend in the motor cannot be obtained by rotating the coiled tubing, an orientation tool 40 is provided immediately above the motor 12, as shown in FIG. 1. An orientation tool 40 is conventionally used when coiled tubing is used to suspend a drill motor in a well, and may be of the type disclosed in U.S. Pat. No. 5,215,151. The orientation tool thus serves the purpose of orienting the motor bend angle at its desired azimuth to steer when the motor housing is slid to build the trajectory.

One of the particular difficulties with building a deviated borehole utilizing a BHA suspended from coiled tubing is that the BHA itself is more unstable than if the BHA is suspended from drill pipe. In part this is due to the fact that the coiled tubing does not supply a dampening action to the same degree as that provided by drill pipe. When a BHA is used to drill when suspended from the coiled tubing, the BHA commonly experiences very high vibrations, which adversely affects both the life of the drill motor and the life of the bit. One of the surprising aspects of the BHA according to the present invention is that vibration of the BHA is significantly lower than the vibration commonly experienced by prior art BHAs. This reduced vibration is believed to be attributable to the long gauge provided on the bit and the short length between the bend and the bit, which increases the stiffness of the lower bearing section. An unexpected advantage of the BHA according to the present invention is that vibration of the BHA is significantly reduced when drilling both the curved borehole section or the straight borehole section. Reduced vibration also significantly increases the useful life of the bit so that the BHA may drill a longer portion of the deviated borehole before being retrieved to the surface.

The surprising results discussed above are obtained with a BHA with a combination of a slick PDM, a short spacing between the bend and the bit face, and a long gauge bit. It is believed that the combination of the long gauge bit and the short bend to bit face is considered necessary to obtain the benefits of the present invention. In some applications, the motor housing may include stabilizers or pads for engagement with the borehole which project radially outward from the otherwise uniform diameter sidewall of the motor housing. Stabilizers may be required in some applications to get the correct build when steering, and also may even further reduce bit whirling and thus hole spiraling. It is currently not known whether a PDM with such stabilizers will perform as well as a BHA with a slick motor. Depending on the application, the advantage of a stronger build when steering and reduced whirling may offset the disadvantage of expected increased drag when sliding the motor during a build operation. Much of the advantage of the invention is obtained by providing a high quality deviated hole which also significantly reduces drag, and that benefit should theoretically still be obtained when the motor includes stabilizers or pads.

By shortening the entire length of the motor, the MWD package may be positioned closer to the bit. Sensors 25 and 27 (see FIG. 3) may be provided within the long gauge section of the drill bit to sense desired borehole or formation parameters. An RPM sensor (tachometer), an inclinometer, and a gamma ray sensor are exemplary of the type of sensors which may be provided on the rotating bit. In other applications, sensors may be provided at the lowermost end of the motor housing below the bend. Since the entire motor is shortened, the sensors nevertheless will be closer to the MWD system 40. Signals from the sensors 25 and 27 are thus transmitted in a wireless manner to the MWD system 40, which in turn transmits wireless signals to the surface, preferably in real time. Near bit information is thus available to the drilling operator in real time to enhance drilling operations.

The steerable system of the present invention offers significantly improved drilling performance with a very high ROP achieved while a relatively low torque is output from the PDM. Moreover, the steering predictability of the BHA is surprisingly accurate, and the hole quality is significantly improved. These advantages result in a considerable time and money savings when drilling a deviated borehole, and allow the BHA to drill farther than a conventional steerable system. Efficient drilling results in less wear on the bit and, as previously noted, stress on the motor is reduced due to less WOB and a lower bend angle. The high hole quality results in higher quality formation evaluation logs. The high hole quality also saves considerable time and money during the subsequent step of inserting the casing into the deviated borehole, and less radial clearance between the borehole wall and the casing or liner results in the use of less cement when cementing the casing or liner in place. Moreover, the improved wellbore quality may even allow for the use of a reduced diameter drilled borehole to insert the same size casing which previously required a larger diameter drilled borehole. These benefits thus may result in significant savings in the overall cost of producing oil.

While only particular embodiments of the apparatus of the present invention and preferred techniques for practicing the method of the present invention have been shown and described herein, it should be apparent that various changes and modifications may be made thereto without departing from the broader aspects of the invention. Accordingly, the purpose of the following claims is to cover such changes and modifications that fall within the spirit and scope of the invention.

What is claimed is:

1. A bottom hole assembly for drilling a deviated borehole, the bottom hole assembly comprising:

a positive displacement motor driven by pumping downhole fluid through a motor stator to rotate an axially curved motor rotor, the motor having a lower bearing section central axis offset at a selected bend angle from a power section central axis by a bend in the motor housing, and the motor having a substantially uniform diameter motor housing outer surface extending axially from an uppermost end of an upper power section to a lowermost end of a lower bearing section; and a long gauge bit powered by the positive displacement motor, the long gauge bit having a bit face defining a bit diameter and a gauge section having a uniform diameter cylindrical surface spaced above the bit face, the gauge section having an axial length of at least 75% of the bit diameter.

2. The bottom hole assembly as defined in claim 1, wherein an axial length along the lower bearing section central axis between the bend and the bit face being less than ten times the bit diameter.

3. The bottom hole assembly as defined in claim 2, further comprising:

a rotatable motor shaft having a pin connection at its lowermost end; and the long gauge bit having a box connection at its upper end for mating interconnection with the pin connection to reduce an axial spacing between a lowermost end of the motor and an uppermost end of the gauge section of the long gauge bit.

4. The bottom hole assembly as defined in claim 3, wherein the rotatable motor shaft extending from the motor housing includes radially opposing flats for engagement with a tool to temporarily prohibit rotation of the motor shaft.

5. The bottom hole assembly as defined in claim 1, wherein the axial spacing between the bend and the bit face is less than eight times the bit diameter, and the bend in the motor housing is less than about 1.25°.

6. The bottom hole assembly as defined in claim 1, wherein the gauge section of the long gauge bit has an axial length of at least 90% of the bit diameter.

7. The bottom hole assembly as defined in claim 1, wherein the length along the power section central axis between an uppermost end of the power section and the bend is less than 40 times the bit diameter.

8. The bottom hole assembly as defined in claim 7, wherein the spacing along the power section central axis between the uppermost end of the power section and the bend is less than 30 times the bit diameter.

9. The bottom hole assembly as defined in claim 1, wherein the bottom hole assembly is supported in the wellbore by drill pipe, such that motor housing is rotated with the drill pipe to form a straight section of the deviated borehole.

10. The bottom hole assembly as defined in claim 1, wherein the motor housing is suspended in the wellbore from coiled tubing.

11. The bottom hole assembly as defined in claim 1, further comprising:

a drill collar assembly above the motor, the drill collar assembly having an axial length less than 200 feet.

12. The bottom hole assembly as defined in claim 1, further comprising:

one or more downhole sensors along the gauge section of the long gauge bit for sensing a desired borehole parameter.

13. A bottom hole assembly for drilling a deviated borehole, the bottom hole assembly comprising:

a positive displacement motor driven by pumping downhole fluid through a motor stator to rotate an axially curved motor rotor, the motor having an upper power section, a bend section having a bend therein, and a lower bearing section, a lower bearing section central axis offset at a selected bend angle from the power section central axis by the bend in the bend section;

a long gauge bit powered by the positive displacement motor, the long gauge bit having a bit face defining a bit diameter and a gauge section having a uniform diameter cylindrical surface spaced above the bit face, the gauge section having an axial length of at least 75% of the bit diameter; and an axial spacing along the lower bearing section central axis between the bend and the bit face being less than ten times the bit diameter.

14. The bottom hole assembly as defined in claim 13, wherein the axial length between the bend and the bit face is less than eight times the bit diameter.

15. The bottom hole assembly as defined in claim 13, further comprising:

a rotatable motor shaft having a pin connection at its lowermost end; and the long gauge bit having a box connection at its upper end for mating interconnection with the pin connection to reduce an axial spacing between a lowermost end of the motor and an uppermost end of the gauge section of the long gauge bit.

16. The bottom hole assembly as defined in claim 13, wherein the bend in the bend section is less than about 1.25°.

17. The bottom hole assembly as defined in claim 13, wherein the length along the power section central axis between an uppermost end of the power section and the bend is less than 40 times the bit diameter.

18. The bottom hole assembly as defined in claim 13, wherein the gauge section of the long gauge bit has an axial length of at least 90% of the bit diameter.

19. The bottom hole assembly as defined in claim 13, further comprising:

a drill collar assembly above the motor, the drill collar assembly having an axial length less than 200 feet.

20. A method of drilling a deviated borehole utilizing a bottom hole assembly including a positive displacement motor having an upper power section with a power section central axis and a lower bearing section with a lower bearing section central axis offset at an selected bend angle from the power section central axis by a bend in a motor housing, the bottom hole assembly further including a bit rotated by the motor and having a bit face defining a bit diameter, the bit being rotated by the motor relative to the motor housing, the method comprising:

(a) providing the motor housing having a substantially uniform diameter outer surface extending axially from an uppermost end of the upper power section to a lowermost end of the lower bearing section;

(b) providing a gauge section on the bit, the gauge section having a uniform diameter cylindrical surface thereon along an axial length of at least 75% of the bit diameter; and (c) pumping fluid through the downhole motor to rotate the bit at a speed of less than 350 rpm while the non-rotating motor housing slidably engages a wall of the borehole to form a cured section of the deviated borehole.

21. The method as defined in claim 20, further comprising:

axially spacing the bend from the bit face less than ten times the bit diameter.

22. The method as defined in claim 20, wherein the bend in the motor housing is less than about 1.25°, and the motor rotates the bit at less than 200 rpm.

23. The method as defined in claim 20, further comprising:

(d) rotating the motor housing within the borehole to rotate the bit to form a straight section of the deviated borehole.

24. The method as defined in claim 23, wherein steps (c) and (d) are each repeated one or more times, and step (d) is performed between two step (c) operations.

25. The method as defined in claim 23, wherein step (c) is performed to drill a penetration distance greater than 25% of the penetration distance while step (d) is performed.

26. The method as defined in claim 20, further comprising:

positioning one or more downhole sensors along the gauge section of the bit to sense a desired downhole parameter.

27. The method as defined in claim 20, further comprising:

spacing an uppermost end of the upper power section from the bend less than 40 times the bit diameter.

28. The method as defined in claim 20, further comprising:

controlling actual weight on the bit such that the bit face exerts less than about 180 pounds axial force per square inch of bit face cross-sectional area.

29. The method as defined in claim 20, further comprising:

providing a drill collar assembly above the motor, the drill collar assembly having an axial length less than 200 feet.

30. A method of drilling a deviated borehole utilizing a bottom hole assembly including a positive displacement motor having an upper power section with a power section central axis and a lower bearing section with a lower bearing section central axis offset at an selected bend angle from the power section central axis by a bend in a motor housing, the bottom hole assembly further including a bit rotated by the motor and having a bit face defining a bit diameter, the method comprising:

(a) providing a motor housing having a substantially uniform diameter outer surface extending axially from an uppermost end of the upper power section to a lowermost end of the lower bearing section;

(b) providing a gauge section on the bit, the gauge section having a uniform diameter cylindrical surface thereon along an axial length of at least 75% of the bit diameter;

(c) axially spacing the bend from the bit face less than ten times the bit diameter; and (d) pumping fluid through the downhole motor to rotate the bit at a speed of less than 350 rpm while the non-rotating motor housing slidably engages a wall of the borehole to form a curved section of the deviated borehole.

31. The method as defined in claim 30, wherein the bend angle is less than about 1.25°, and the motor rotates the bit at less than 200 rpm.

32. The method as defined in claim 30, further comprising:

spacing an uppermost end of the upper power section from the bend less than 40 times the bit diameter.

33. The method as defined in claim 30, further comprising:

suspending the motor in the wellbore from coiled tubing; and providing a orientation tool above the motor.

34. The method as defined in claim 30, further comprising:

controlling actual weight on the bit such that the bit face exerts less than about 180 pounds axial force per square inch of bit face cross-sectional area.

* * * * *